US007516816B2

(12) United States Patent
Higgs

(10) Patent No.: US 7,516,816 B2
(45) Date of Patent: Apr. 14, 2009

(54) SAFETY RAIL ASSEMBLY

(75) Inventor: Philip Maurice Higgs, Berkshire (GB)

(73) Assignee: Kee Klamp Limited, Reading (GB)

( * ) Notice: Subject to any disclaimer, the term of this patent is extended or adjusted under 35 U.S.C. 154(b) by 0 days.

(21) Appl. No.: 11/727,979

(22) Filed: Mar. 29, 2007

(65) Prior Publication Data

US 2007/0228352 A1 Oct. 4, 2007

(30) Foreign Application Priority Data

Mar. 30, 2006 (GB) ..... 0606334.1

(51) Int. Cl.
*E04G 3/26* (2006.01)

(52) U.S. Cl. ..... 182/45; 182/113

(58) Field of Classification Search ..... 182/45, 182/113

See application file for complete search history.

(56) References Cited

U.S. PATENT DOCUMENTS

| | | | | |
|---|---|---|---|---|
| 3,776,521 | A | 12/1973 | Weinert | |
| 5,107,959 | A * | 4/1992 | Lubinski | 182/222 |
| 5,377,958 | A * | 1/1995 | Palmer | 256/59 |
| 6,272,800 | B1 * | 8/2001 | Phinney et al. | 52/200 |
| 6,467,230 | B1 * | 10/2002 | Perkins et al. | 52/655.1 |
| 6,688,046 | B2 * | 2/2004 | Perkins | 52/19 |
| 6,902,153 | B1 | 6/2005 | Kenton | |
| 2002/0124786 | A1 | 9/2002 | Perkins | |
| 2004/0154241 | A1 | 8/2004 | Joyce et al. | |
| 2005/0006634 | A1 | 1/2005 | Cuccurullo | |

FOREIGN PATENT DOCUMENTS

| | | |
|---|---|---|
| DE | 3842435 | 7/1990 |
| GB | 2323883 | 10/1998 |

* cited by examiner

*Primary Examiner*—Alvin Chin-Shue
*Assistant Examiner*—Candace L Bradford
(74) *Attorney, Agent, or Firm*—Young & Thompson

(57) ABSTRACT

A safety rail assembly for surrounding a structure protruding from a support surface comprises at least three base units for positioning in a free-standing manner on the support surface, support members each extending substantially vertically from a respective base unit, and barrier members each extending between and supported by a respective pair of successive support members, each base unit comprising a side face which faces inwards of the assembly towards another of the base units or a position between two or more other base units of the assembly, and each side face being of a shape which defines a recess which accommodates part of the protruding structure thereby to restrain lateral movement of the safety rail assembly away from the protruding structure.

14 Claims, 3 Drawing Sheets

SAFETY RAIL ASSEMBLY

FIELD OF THE INVENTION

This invention relates to a safety rail assembly and in particular, though not exclusively, to a safety rail assembly for restraining access to an area of a roof or floor surface which may present a safety hazard, for example to restrain inadvertent access to a skylight.

The invention relates also to a base unit of a type which is particularly suitable for use in a safety rail assembly of the present invention, and to a method of protecting against inadvertent access to an area of a roof or floor surface which may present a safety hazard.

BACKGROUND OF THE INVENTION

A disadvantage of some types of known safety rail assembly constructions is that they require to be fixed in position by anchoring devices that penetrate the weatherproof surface of a roof or floor, thus creating a potential for water penetration when any sealing material around the anchoring device degrades.

In some other safety rail assembly constructions special adjustable clamping devices need to be provided and mounted on the assembly to engage with a skylight to retain the safety rail assembly against lateral movement. This adds to cost and time.

SUMMARY OF THE INVENTION

The present invention seeks to provide a safety rail assembly, a base unit for a safety rail assembly, and a method of protecting against inadvertent access to an area of a roof or floor surface in which the aforementioned disadvantages are mitigated or overcome.

In accordance with one aspect of the present invention there is provided a safety rail assembly for surrounding a structure protruding from a support surface, said safety rail assembly comprising at least three base units for positioning in a free-standing manner on a support surface, support members each extending in use substantially vertically from a respective base unit, and barrier members each extending in use between and supported by a respective pair of successive support members, each base unit comprising a side face which, in the assembly, faces inwards towards another of the base units or a position between two or more other base units of the assembly, and each said side face being shaped to define a recess which, in use, accommodates part of the protruding structure thereby to restrain lateral movement of the safety rail assembly away from the protruding structure.

The invention provides also a method of restraining inadvertent access to a structure protruding from a support surface such as a floor or roof, said method comprising use of a safety rail assembly of a type in accordance with the present invention and wherein each base unit is positioned in contact with or close to a part of the protruding structure with at least a part of the recess of each base unit being occupied by a part of the protruding structure.

The protruding structure may be of a two part form comprising for example a plinth portion which surrounds an opening in the support surface and a cover member which is supported by, and typically is secured and sealed to, the plinth portion. The cover member, such as a skylight, may be of a type which overhangs the plinth portion and the method of the invention may comprise use of a base unit either of a height sufficient to engage with a periphery of the overhanging cover member or of a height sufficiently small to extend under the overhanging cover member and engage with the plinth portion.

In yet another aspect of the present invention there is provided a base unit for use with the safety rail assembly and method of the present invention, said base unit comprising a lower face for resting on a support surface and a side face which, as viewed in plan in a direction perpendicular to the lower face, defines a recess which, in use, may be arranged to accommodate part of a corner of a protruding structure of a substantially polygonal shape or part of an edge region of a protruding structure of a curved profile.

The base unit preferably is constructed in the form of a counter balance weight which assists in providing the safety rail assembly with stability and resistance to toppling.

Preferably the support members and barrier members are substantially rigidly interconnected relative to one another and, more preferably, also to the base units. In consequence any tendency for toppling of any one of the base units or pair of base units is resisted by the leverage effect of the weight of both the safety rail assembly members and base unit(s) at positions horizontally remote from the axis about which toppling might otherwise occur. In that case the base units do not necessarily need to be of a substantial weight sufficient alone to resist toppling by forces acting on a support member associated with that base unit. Alternatively, however, and particularly in a construction in which the support and barrier members are not rigidly interconnected relative to one another and the base units, the base units may be of a more substantial weight such that they are each able independently to resist any tendency to topple in consequence of forces that might be expected, in use, to act on a support member associated with a respective base unit.

Each base unit may be of a substantially solid construction, for example constructed by moulding or casting. One example of a suitable material is recycled polyvinylchloride.

The lower face of each base unit preferably is substantially planar, by which is meant herein that it can rest in a stable manner on a flat surface without any significant tendency to rock or tilt. Preferably said lower surface has smooth edges to ensure absence of any sharp corners that might otherwise penetrate or damage a support surface. Said lower surface may be shaped to define at least one, and preferably a pair of profiled regions, e.g. notches, to act as handholds for lifting and movement of the base units. It may also be relieved, for example by the presence of moulded cavities and/or may have a textured finish which may additionally resist any tendency for sliding movement. The lower face may be defined by a layer of material, such as a cushioning layer of elastomeric material, bonded or otherwise secured to a main body of the base unit.

Typically the protruding structure will be of a profile comprising four right angled corners. In that case the safety rail assembly preferably comprises four base units and support members.

The recess defined by a side face of the base unit may comprise a pair of recess faces which, as viewed in plan, in a plane parallel with that of the lower face of the base unit, lie substantially at right angles to one another. The base unit may comprise a pair of limb portions extending from a common central body portion, for example substantially of an "L" shape. The resulting recess, referred to herein as a square-type recess, is particularly suitable for use in association with a protruding structure which is of a rectangular, e.g. square or oblong shape. It may, however, also be employed for use in association with a protruding structure which is of another shape, such as a circular, oval or hexagonal shape. In the case of a protruding structure having a curved profile, although a square type recess may be employed, the base unit alternatively may be provided with a recess which is defined by a recess face of a curved profile, preferably of a curvature corresponding substantially to that of the protruding structure with which the base unit is to be associated.

As considered in a plane parallel with that of a lower face of the base unit, the outer profile of the base unit preferably is substantially symmetrical in a first direction but asymmetrical in a second direction perpendicular to said first direction.

Preferably the base unit comprises retention means for supporting a support member, and preferably said retention means is positioned on a line about which the base unit is substantially symmetrical.

Whilst it has been described that the recess in a side face of a base unit may be defined by a pair of recess faces, and that a base unit of that form may be employed for use in relation to protruding structures of either polygonal or curved profile, if the protruding structure has a profile of a non-rectangular polygonal shape the recess may comprise a pair of recess faces which lie angled relative to one another to complement the outer angle at a corner of the polygonal shape of the protruding structure. Thus if the protruding structure has an external profile of hexagonal shape, the faces of the recess may lie at an angle of 120° relative to one another.

The base unit preferably comprises a passage extending substantially perpendicular relative to the lower face of the base unit for receiving an end of a support member, such as a vertical support post. The passage may be a through-passage, or may be a blind passage closed at the lower face of the base unit thereby to prevent the end of the support tube contacting and potentially damaging the surface on which the base unit is supported.

The base unit may comprise means for retention of a support member in the passage, to prevent the support member being removed from the passage.

For retention of a support member in the base unit the base unit optionally may comprise a cavity region in which a retainer, such as a retention ring may be located and held captive when secured to a portion of the support member extending through that cavity.

Said cavity may lie between two passage sections. The passage sections may each be dimensioned as a close fit with a support member such that the support member is supported by the base unit at positions above and below the cavity region in a manner to resist tilting of the support member relative to the base unit. Accordingly said upper and lower passage regions may be of circular cross-section and of the same diameter or of a diameter only slightly greater than that of the diameter of the tube or other like support member to be inserted in the base unit whereby the support member is secured in a manner that inhibits any significant tilting movement relative to the base unit.

Alternatively, at least one of the two passage sections may have a larger size, e.g. larger diameter than the other such that when a support member such as a support post is retained vertically by a retainer to resist outward movement from the base unit, the support member nevertheless is able to tilt slightly relative to the base unit. Thus the assembly of support members may all be arranged to extend substantially vertically despite any local irregularities of the support surface, with that surface irregularity being accommodated by virtue of the ability of each support member to tilt slightly relative to a base unit.

The retainer may be in the form of a retainer ring having a screw-threaded aperture to receive a locking device, such as a grub screw which can be tightened to bear against and thereby secure the retainer ring to the support member. The screw-threaded aperture may have a boss portion associated therewith, extending radially outwards of the ring and the dimension of the cavity may be such that when the retainer is secured to the support member the boss is always visible through an access opening of the cavity, and not able to be rotated to a position at which it ceases to be accessible for re-tightening or release.

The support member passage of the base unit preferably is positioned substantially centrally, in a central body portion mid-way between ends of limb portions of the base unit.

At least a part of a central body portion may have a height, as considered relative to a lower face of the base unit, which is greater than the height of limb portions extending from a central body portion of the based unit. Preferably at least that part of a central body portion which defines the support member passage is of a greater height than the limb portions.

Preferably the centre of gravity of the base unit, as viewed in plan, in a plane parallel with that of the lower face of the base unit, lies offset from the support member passage. More preferably said centre of gravity lies offset from a body of the base unit. Thus it may lie outside the profile of the base unit, for example in the region of the recess defined by the side face(s) of the base unit.

It has been described above that the barrier members may be rigidly inter-connected relative to the support members and base unit. For that purpose it is envisaged that typically the barrier members will be of a rigid, non-articulated type whereby the barrier and support members may play a significant part in providing resistance to toppling, without having to rely on the weight of the base units.

Examples of rigid type barrier members are metal bars or tubes, and also panels of substantially rigid material such as metal plates or grids. A barrier member in the form of a panel preferably is secured to a support member at two or more positions spaced along the support member. Particularly in the case of a safety rail assembly for surrounding a skylight, if a barrier member is in the form of a panel, it may be preferred that the panel is of transparent material.

Rigid metal tubes, e.g. galvanized tubes, are particularly suitable for forming the support and barrier members, and may be rigidly inter-connected by connectors of a type comprising sockets each for receiving the end of a tube and optionally also a through-bore through which a tube may extend, with the tubes being secured relative to the connectors by retention means such as grub screws provided in screw-threaded apertures in the wall of the socket or through-bore. Particularly suitable connectors are those of the kind available from Kee Klamp Limited.

For the purpose of facilitating ease of insertion of a support member into a base unit, and to extend through the bore of a retainer ring positioned in a base unit cavity, the bore of the retainer ring may be of a tapered form at least one of its ends so that as a support member moves towards the retainer ring the retainer ring tends to self-centralize. Although it will be sufficient for just one end of the aperture of the retainer ring to be tapered outwards, to avoid the need to selectively position the retainer ring in the base unit cavity with the outwardly tapered end facing upwards towards the support member, preferably both ends of the retainer ring are outwardly tapered. In an alternative or further option the base unit may be shaped to define an annular recess within the base unit cavity for the purpose of accommodating and accurately locating an axial end region of a retainer ring such that it lies accurately aligned with the passage sections.

BRIEF DESCRIPTION OF THE DRAWINGS

One embodiment of the present invention will now be described, by way of example only, with reference to the accompanying diagrammatic drawings in which:—

DETAILED DESCRIPTION OF THE PREFERRED EMBODIMENTS

Figure 1:
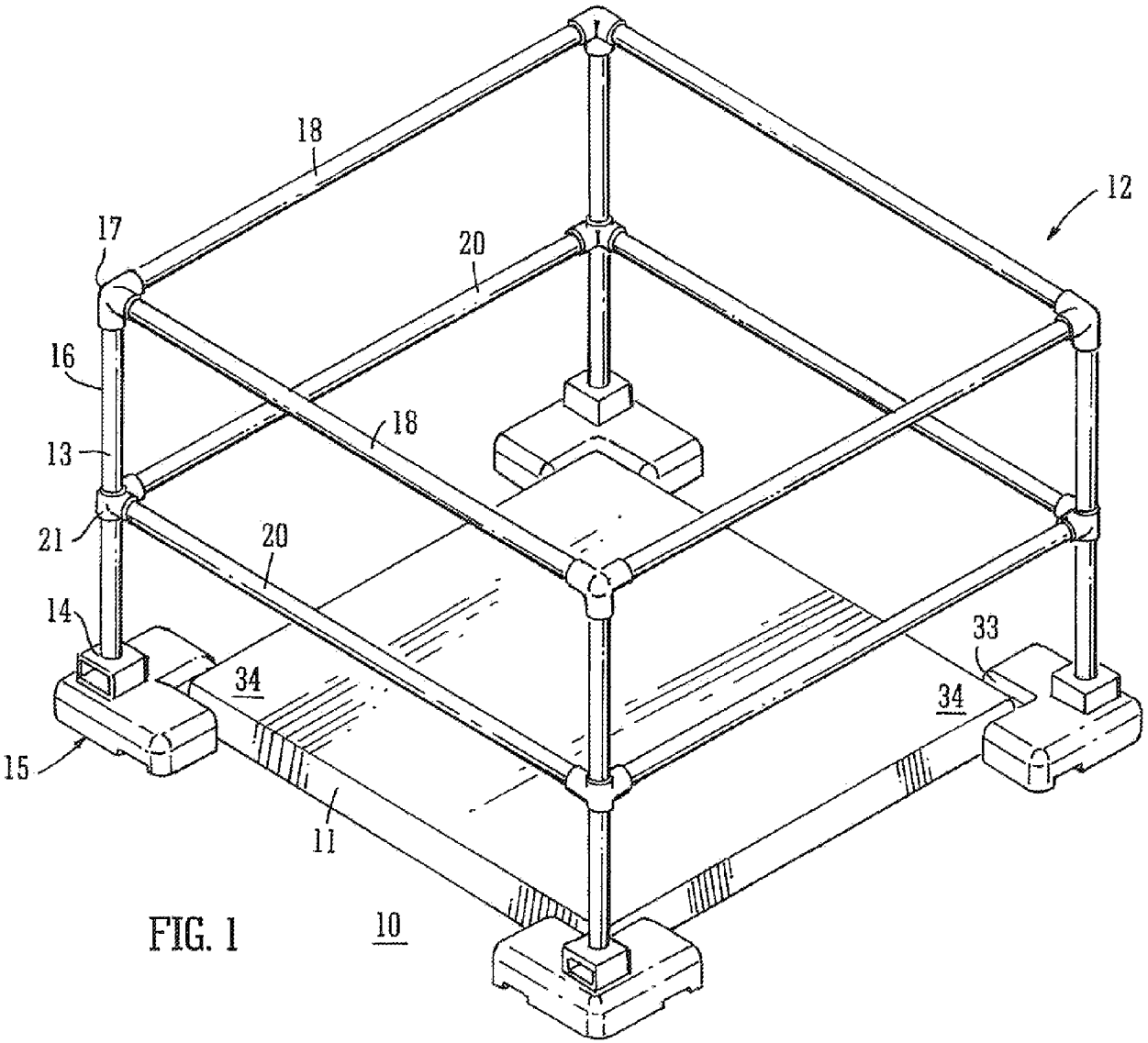
FIG. 1 is a perspective view of a safety rail assembly in accordance with the present invention in situ on a roof surface to surround a skylight.

With reference to FIG. 1, a roof surface 10 is provided with a protruding structure in the form of a square-shaped skylight 11. The periphery of the skylight rests on or lies close to the support surface 10.

In this embodiment the illustrated skylight 11 has only a slightly domed upper surface but it is to be understood that the skylight may be of other conventional form such as one which is more distinctly domed.

The skylight 11 is surrounded by a safety rail assembly 12 for the purpose of restraining inadvertent access to the skylight and ensuring that personnel are not at risk of walking on or impacting the skylight and falling therethrough.

The safety rail assembly 12 comprises four vertical posts 13 each having a lower end which is received in and secured to a passage 14 in a base unit 15 in a manner described in more detail below.

Figure 2:
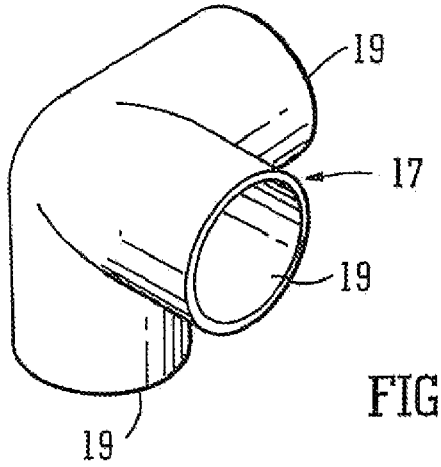
FIG. 2 is a perspective view of an upper connector for the assembly of FIG. 1.

The upper ends 16 of the posts 13 are provided with rigid tube connectors 17 of a kind know per se whereby neighboring posts are rigidly inter-connected by tubular guard rails 18. Each connector 17 is shown in more detail in FIG. 2 and comprises three mutually perpendicular sockets 19. The wall of each socket is provided with a screw-threaded aperture (not shown) which contains a grub screw which can be tightened to bear against the outer surface of the end of a guard rail tube or vertical post to form a rigid inter-connection.

Figure 3:
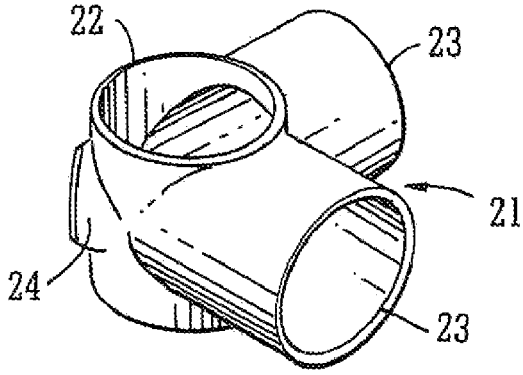
FIG. 3 is a perspective view of a mid height connector of the assembly of FIG. 1.

Additionally the neighboring posts are each rigidly interconnected by a tubular mid-rail 20. The rigid inter-connection with the mid-rails is achieved by means of rigid connectors 21 (see FIG. 3) comprising a through-bore 22 and two sockets 23. The sockets 23 are each provided with a screw-threaded aperture and grub screw in the manner described above in respect of the sockets 19, and the through-bore 22 has a boss region 24 which similarly is provided with a screw-threaded aperture and grub screw. The guard rails 18 and mid-rails 20 are all of the same length.

Each base unit 15 (see FIG. 4) is a substantially solid body of moulded recycled polyvinylchloride. It comprises a central body portion 25 and two limb portions 26 which extend generally perpendicularly relative to one another.

Each base unit 15 has a substantially planar lower face 27, and the region of the lower face under each limb portion 26 has a transversely extending notch 28 which serves as a handhold to facilitate lifting and movement of the base unit.

The base unit has a side face 30 comprising two side face portions 31, 32 which extend perpendicularly to one another as viewed in plan in a direction perpendicular to the plane of the lower face 27. The two side face portions define a recess region 33 which, in use, as shown in FIG. 1, accommodates a corner region 34 of the skylight 11.

Extending upwards from the central body portion 25 of each base unit 15 is a turret formation 35 which defines part of the passage 14 in which the lower end of a post 13 is located.

The turret 35 has four side walls 36 which extend upwards from the central body portion 25, and one of the side walls is formed with an aperture 37 which give access to a cavity 38. The cavity 38 separates a first passage section 39 in an upper wall surface 40 of a turret and a second passage section 41 that extends downwards into the central body portion of the base unit. The lower passage portion is in the form of a blind bore such that the end of a post 13 is supported by the material of the base unit, thereby ensuring that the end of the post cannot contact and potentially damage the roof surface 10.

Figure 5:
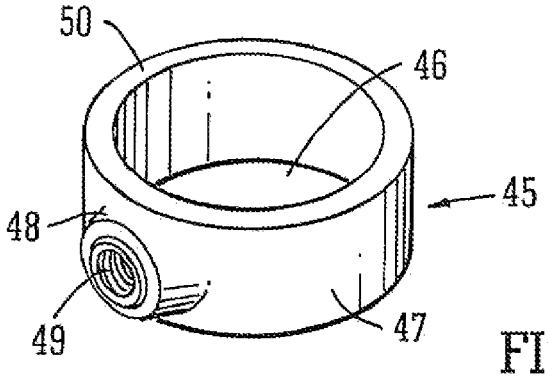
FIG. 5 is a perspective view of a retainer ring of the assembly of FIG. 1.

To retain a post 13 in a base unit and prevent the post being lifted upwards out of the passage 14 a retainer ring 45 (see FIG. 5) is provided in the turret cavity 39.

The retainer ring 45 has a central bore 46 of a diameter slightly greater than that of the upper and lower passage section 39, 41 such that the end of a post may pass freely through the retainer ring. Additionally the outer surface 47 of the retainer ring is of a generally cylindrical shape having a radius slightly less than the distance between the axis of each passage section 39, 41 and inner face of the two opposing side wall sections 36 and the third side wall section of the turret opposite the cavity aperture 37. In consequence, when the retainer ring is inserted fully into the cavity, the bore of the retainer ring 45 is substantially aligned with the passage sections. To facilitate ease of insertion of the lower end of a post into the lower passage section 41 the retainer ring has an internal bore which is outwardly tapered at one or each end so that it tends to self-centre when a post is dropped into the base unit.

Although the outer surface of the retainer ring 45 is of a generally cylindrical shape, it is provided with a boss region 48 which surrounds a screw-threaded aperture 49 extending through the wall 50 of the retainer ring and which contains a grub screw (not shown). Tightening of the grub screw against the outer surface of the lower end of a post secures the retainer ring axially relative to the length of the post, thereby to ensure that the post cannot subsequently be lifted from the base unit.

Figure 4:
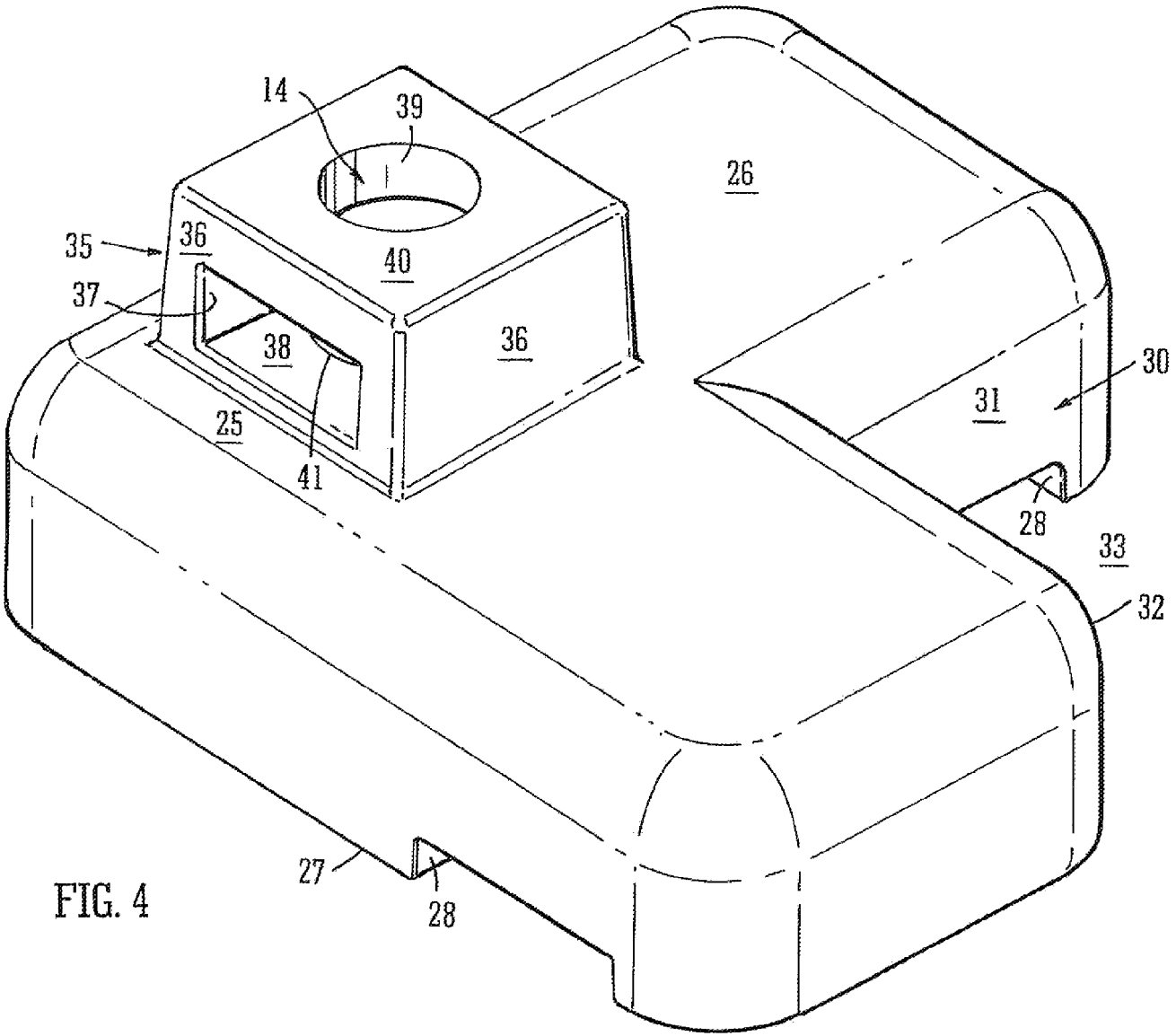
FIG. 4 is a perspective view of a base unit of the assembly of FIG. 1.

In the illustrated embodiment of the invention the base units 15 are handed, two of the base units having the cavity aperture 37 provided in the position shown in the base unit of FIG. 4 whereas the other two base units, being those shown centrally at the upper and lower positions of FIG. 1, have the cavity aperture in that other side of the turret 35 which faces outwards from the skylight 11. Alternatively all four base units may be identical.

In another embodiment of the invention, not illustrated, the first, upper passage section 39 has a diameter greater than that of the second passage section 41 thereby to allow formation of an assembly in which the vertical post lies slightly inclined from a direction perpendicular to the plane of the lower face 27 of the base unit. In consequence the base unit may rest firmly on the roof surface 10 not withstanding any local irregularities in the flatness of that surface.

A particular advantage arising from base units of the type the subject of the present invention, and a safety rail assembly comprising base units of a type having a recess, is that the resulting safety rail assembly co-operates with the boundary of a protruding structure to inhibit any sliding movement of the safety rail assembly away from that area which may present a safety hazard.

Thus, without any need to permanently to secure the support members either to the protruding structure or surrounding support surface, it is ensured that the safety rail assembly remains correctly positioned to provide the required safety function.

Whilst the invention is of particular benefit for providing protection around a skylight, such as a domed skylight, it may be employed also to provide protection around other structures such as a ventilation hatch or plant or machinery.

The invention claimed is:

1. A safety rail assembly for surrounding a structure protruding from a support surface, said safety rail assembly comprising:

at least three base units for positioning in a free-standing manner on a support surface, support members each extending in use substantially vertically from a respective base unit;

barrier members each extending in use between and supported by a respective pair of successive support members;

each base unit comprising: a substantially planar lower face; a side face of the shape which, as viewed in a direction perpendicular to the plane of the lower face, defines a recess which in use, accommodates part of the structure protruding from a surface on which the base unit rests, each said side face faces inwards towards another of the base units or a position between two or more other base units of the assembly, and, as viewed in a direction parallel with a length of the support members extending from the base unit, each said side face defining said recess, so that said recess restrains lateral movement of the safety rail assembly away from the protruding structure, in two mutually perpendicular directions which are each perpendicular to the length of a support member;

a passage extending from an upper face of each said base unit towards a respective lower face in a direction substantially perpendicular relative to said lower face of the base unit for receiving a lower end of one of said support members, said passage comprising two coaxial spaced apart passage sections each for providing support to said one of said support members;

a cavity between said two spaced part passage sections which is aligned with said passage; and a retainer located within said cavity and held captive when secured to portion of a support member extending through said cavity said retainer being in the form of a retainer ring having a screw-threaded aperture to receive a locking device, wherein the retainer ring comprises a boss portion, which extends radially outwards of the retainer ring, said screw-threaded aperture extending through said boss portion, and the dimensions of the retainer ring and cavity being such that when the retainer is secured to a support member, the boss portion is always visible through an access opening that provides access to the cavity and is unable to rotate to a position at which it ceases to be accessible for re-tightening or release.

2. The safety rail assembly according to claim 1 wherein the support members and barrier members are substantially rigidly interconnected relative to one another, and are substantially rigidly connected to the base unit.

3. The safety rail assembly according to claim 1 wherein each base unit has a lower face which is substantially planar.

4. The safety rail assembly according to claim 1 wherein the lower face of each base unit is shaped to define at least one profiled region which acts in use as a hand hold for lifting and movement of the base unit.

5. The safety rail assembly according to claim 1, wherein the lower face of each base unit is at least one of relieved and textured to resist sliding movement.

6. The safety rail assembly according to claim 1 wherein the lower face of each base unit is defined by a layer of elastomeric material.

7. The safety rail assembly according to claim 1 wherein the recess defined by the side face of each base unit comprises a pair of recess faces which, as viewed in plan, in a plane parallel with that of the lower face of the base unit, lie substantially at right angles to one another.

8. The safety rail assembly according to claim 1 wherein the each said base unit further comprises a pair of limb portions which extend from a common central body portion.

9. The safety rail assembly according to claim 1 wherein each said passage is closed at a lower face of the base unit to prevent the end of a support member contacting a surface on which the base unit is supported.

10. The safety rail assembly according to claim 1 wherein said two passage sections are each dimensioned to be a close fit with a support member.

11. The safety rail assembly according to claim 1 wherein at least one of the two passage sections has a larger size than the size of a support member received therein whereby, in use, the support member is able to tilt slightly relative to she base unit.

12. The safety rail assembly according to claim 1 wherein the protruding structure comprises a plinth portion and a cover member which Is supported by and overhangs the plinth portion, a height of she base unit being selected to be one of a height sufficient to engage with a periphery of the overhanging cover member and a height sufficiently small to extend under the overhanging cover member and engage with the plinth portion.

13. A base unit for a safety rail assembly, said base unit comprising:

a substantially planar lower face;

a side face of a shape which, as viewed in a direction perpendicular to the plane of the lower face, defines a recess which, in use, accommodates part of a structure protruding from a surface on which the base unit rests;

a passage extending from an upper face of said base unit toward said lower face in a direction substantially perpendicular relative to said lower face of the base unit for receiving the lower end of a support member, said passage comprising two coaxial spaced apart passage sections each for providing support to said support member;

a cavity between said two spaced part passage sections, which is aligned with said passage; and a retainer located within said cavity and held captive when secured to a portion of a support member extending through said cavity, said retainer being in the form of a retainer ring having a screw-threaded aperture to receive a locking device, wherein the retainer ring comprises a boss portion, which extends radially outwards of the retainer ring, said screw-threaded aperture extending through said boss portion, and the dimensions of the retainer ring and cavity being such that when the retainer is secured to a support member, the boss portion is always visible through an access opening that provides access to the cavity and is unable to rotate to a position at which it ceases to be accessible for re-tightening or release.

14. The base unit according to claim 13 wherein the base unit comprises a pair of limb portions which extend from a central body portion and said passage and cavity are defined by said central body portion.

* * * * *